US009721414B2

(12) United States Patent
Ledoux et al.

(10) Patent No.: US 9,721,414 B2
(45) Date of Patent: Aug. 1, 2017

(54) DOCUMENT CASSETTE DISPLACEMENT ACTUATOR FOR DOCUMENT ACCEPTOR

(71) Applicant: MEI, Inc., Malvern, PA (US)

(72) Inventors: Alexandre Francois Ledoux, Lower Gwynedd, PA (US); David Adam Blasko, Collegeville, PA (US); Donald Lee Seagle, Sandy Valley, NV (US)

(73) Assignee: Crane Payment Innovations, Inc., Malvern, PA (US)

( * ) Notice: Subject to any disclaimer, the term of this patent is extended or adjusted under 35 U.S.C. 154(b) by 101 days.

(21) Appl. No.: 14/530,076

(22) Filed: Oct. 31, 2014

(65) Prior Publication Data

US 2016/0125681 A1 May 5, 2016

(51) Int. Cl.

| | |
|---|---|
| ***G07F 7/04*** | (2006.01) |
| ***G07D 7/00*** | (2016.01) |
| ***G07D 11/00*** | (2006.01) |

(52) U.S. Cl.

CPC ..... *G07D 7/00* (2013.01); *G07D 11/0006* (2013.01); *G07D 11/0081* (2013.01); *G07D 2207/00* (2013.01)

(58) Field of Classification Search

CPC ..... G07D 11/0003; G07D 11/0006; G07D 11/0009; G07D 11/0012; G07D 11/0015; G07F 9/06

USPC ..... 194/206, 207, 350; 209/534; 235/379; 74/36, 526, 527, 528, 531, 532, 10.9; 902/13; 232/1 D, 31, 32, 15, 16

See application file for complete search history.

(56) References Cited

U.S. PATENT DOCUMENTS

| | | | | |
|---|---|---|---|---|
| 2,604,343 | A * | 7/1952 | Fredholm | E05C 19/04 292/340 |
| 3,144,267 | A * | 8/1964 | Schmid | E05C 17/28 16/49 |
| 3,244,415 | A * | 4/1966 | Lunenschloss | E05F 15/50 49/137 |
| 5,615,623 | A | 4/1997 | Capraro, Jr. | |
| 5,996,888 | A * | 12/1999 | Gromatzky | G07F 7/04 194/206 |
| 6,000,555 | A * | 12/1999 | Anma | G07D 11/0081 209/534 |
| 6,039,164 | A | 3/2000 | Waters et al. | |
| 6,651,796 | B2 | 11/2003 | Chou | |

(Continued)

FOREIGN PATENT DOCUMENTS

| | | |
|---|---|---|
| EP | 0784299 | 7/1997 |
| EP | 2315185 | 4/2011 |

(Continued)

OTHER PUBLICATIONS

International Search Report and Written Opinion issued for PCT/US2015/058110 with mailing date of Feb. 4, 2016, 11 pgs.

*Primary Examiner* — Jeffrey Shapiro

(57) ABSTRACT

A document acceptor for authenticating and storing documents includes a document validator, a document cassette and a displacement actuator. The document validator is for authenticating received documents. The document cassette is for storing the documents received by the document validator. The displacement actuator is adapted to change a position of the document cassette from a first position to a second position to mate the document cassette with the document validator. Related apparatus, systems, techniques, and articles are also described.

21 Claims, 19 Drawing Sheets

(56) References Cited

U.S. PATENT DOCUMENTS

| | | | | |
|---|---|---|---|---|
| 7,611,045 | B1 | 11/2009 | Lute et al. | |
| 7,644,914 | B2 | 1/2010 | Katou et al. | |
| 7,780,072 | B1 | 8/2010 | Lute et al. | |
| 7,971,775 | B2 | 7/2011 | Saltsov et al. | |
| 8,117,973 | B1 | 2/2012 | Frank | |
| 8,177,223 | B2 | 5/2012 | Bauer et al. | |
| 8,356,703 | B2 * | 1/2013 | Vysma | G07F 1/04 194/206 |
| 8,387,977 | B2 | 3/2013 | Nireki | |
| 8,479,909 | B2 * | 7/2013 | King | G07D 5/00 194/302 |
| 8,528,715 | B2 | 9/2013 | Seki et al. | |
| 8,622,384 | B2 | 1/2014 | Nireki | |
| 8,640,849 | B2 | 2/2014 | Nireki | |
| 8,746,433 | B2 | 6/2014 | Seki | |
| 8,763,779 | B2 | 7/2014 | Nireki | |
| 2002/0056960 | A1 | 5/2002 | Bergeron et al. | |
| 2006/0081441 | A1 * | 4/2006 | Vysma | G07F 1/04 194/206 |
| 2007/0199796 | A1 | 8/2007 | Gunst et al. | |
| 2009/0095593 | A1 * | 4/2009 | King | G07F 17/24 194/302 |
| 2009/0293562 | A1 * | 12/2009 | Fisher | E05B 19/0005 70/278.7 |
| 2010/0090366 | A1 * | 4/2010 | Sutton | B29C 47/0021 264/209.3 |
| 2011/0198191 | A1 * | 8/2011 | Nireki | B65H 29/46 194/206 |
| 2013/0244775 | A1 | 9/2013 | Comfort | |
| 2015/0231924 | A1 * | 8/2015 | Hensel | B60B 31/00 81/485 |

FOREIGN PATENT DOCUMENTS

| | | | |
|---|---|---|---|
| JP | 2009211559 | A | 9/2009 |
| JP | 4366434 | B2 | 11/2009 |
| WO | WO 2011/014041 | | 2/2011 |
| WO | WO-2011052189 | A1 | 5/2011 |

* cited by examiner

DOCUMENT CASSETTE DISPLACEMENT ACTUATOR FOR DOCUMENT ACCEPTOR

TECHNICAL FIELD

The subject matter described herein relates to a document cassette displacement actuator capable of, for example, mating a document cassette with a document validator.

BACKGROUND

A document acceptor is a device that determines whether documents, such as currency bills, are genuine or counterfeit, and stores the accepted documents. These devices can be used in many automated machines found in retail kiosks, self-checkout machines, gaming machines, transportation parking machines, automatic fare collection machines, vending machines, and the like.

In operation, if the document is authenticated the document acceptor retains the document and places it in a storage container for later collection. If the document acceptor rejects the document, the document acceptor returns the document by pushing the document out and the user must remove it from the slot in which it was placed.

The storage container has a limited capacity and once a storage container is filled with documents, the storage container can be removed from the document acceptor and replaced with an empty storage container. But the replacement storage container may not properly connect to the document acceptor and removing the full storage container and inserting the replacement storage container may only be possible from limited orientations (for example, access may only be available from the front of the document acceptor), which may limit the possible uses of the document acceptor.

SUMMARY

In an aspect, a document acceptor for authenticating and storing documents includes a document validator, a document cassette and a displacement actuator. The document validator is for authenticating received documents. The document cassette is for storing the documents received by the document validator. The displacement actuator is adapted to change a position of the document cassette from a first position to a second position to mate the document cassette with the document validator.

In another aspect, a displacement actuator includes a housing and an interface. The housing is adapted to removably secure the displacement actuator to a document acceptor. The interface is adapted to change a position of a document cassette from a first position to a second position to mate the document cassette with a document validator. The document validator is for authenticating received documents and the document cassette is for storing the documents received by the document validator.

In yet another aspect, a document acceptor includes a document validator, a document cassette, and means for changing a position of the document cassette. The document validator is for authenticating received documents. The document cassette is for storing the documents received by the document validator. The means is for changing a position of the document cassette from a first position to a second position to mate the document cassette with the document validator.

One or more of the following features can be included in any feasible combination. For example, the displacement actuator can include a handle. Actuation of the handle can cause the displacement actuator to change the position of the document cassette from the first position to the second position to mate the document cassette with the document validator. Actuation of the handle through a predetermined range of motion can cause the displacement actuator to change the position of the document cassette to the second position. The second position can vary based on a position of the document validator.

A chassis can be included coupling the document validator and the displacement actuator. The chassis can be adapted to allow insertion and removal of the document cassette from a rear orientation of the document acceptor. The displacement actuator can be adapted to lift the document cassette in a vertical direction from the first position to the second position. The chassis can couple the document validator and the displacement actuator. The displacement actuator can be held in a fixed position relative to the document validator. The chassis can couple the document validator and the displacement actuator. The displacement actuator can include a housing being removably secured to the chassis.

The first position can be an initial position and the second position can be a final position. The displacement actuator can be adapted to cause the position of the document cassette to change to the initial position or the final position when the position of the document cassette is not the initial position or the final position. The displacement actuator can include a lever for actuation and an assist mechanism that provides mechanical advantage such that changing the position of a document cassette containing documents requires substantially the same amount of force on the lever as changing the position of a document cassette that is empty of documents.

A cassette detection unit can be included and adapted to detect whether the document cassette is mated with the document validator. A chassis can be included and the document cassette can include features adapted to soft lock the document cassette to the chassis when the displacement actuator is in a down position and the document cassette can be removed. The features can be further adapted to lock the document cassette to the chassis when the displacement actuator is in an up position and the document cassette is mated to the document validator.

The document validator can have one or more gear projections preventing solely horizontal insertion of the document cassette into a mating position with the document validator.

The displacement actuator can include a lever, a cam operatively coupled to the lever, and a spring biasing the cam in a first cam position or a second cam position. Rotation of the lever can cause the cam to transition between the first cam position and the second cam position.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

The subject matter described herein includes a document cassette displacement actuator capable of mating a document cassette with a document validator. In some implementations, the displacement actuator can enable a rear-access document acceptor (e.g., rear-access to the document cassette) for "through-the-wall" applications. Moreover, in some implementations, front-access document acceptors can be retrofit with a displacement actuator to enable rear-access without significant modification of the front-access document acceptors.

Figure 1:
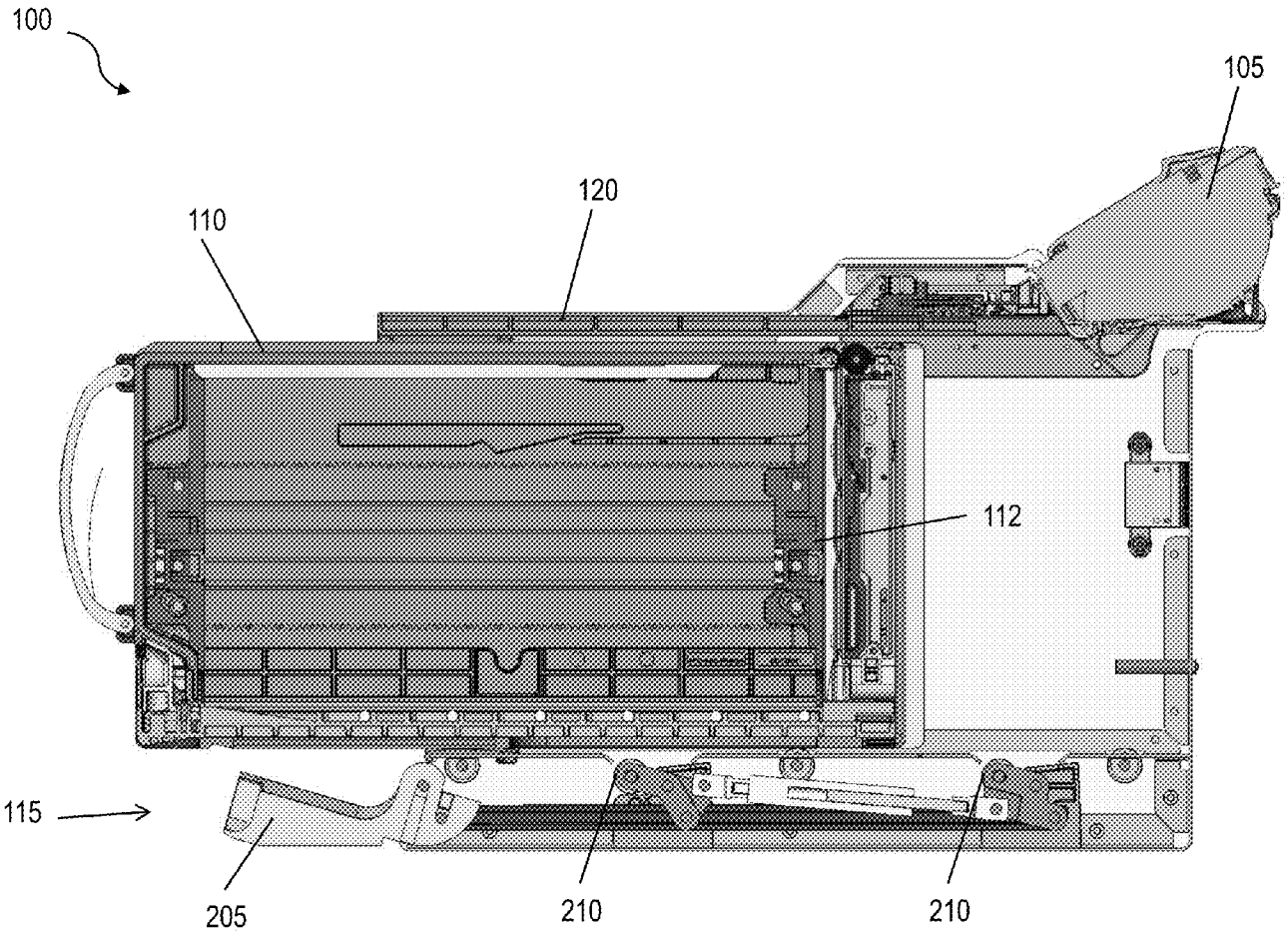
FIG. 1 is a cross sectional view of an example implementation of a document acceptor.

FIG. 1 is a cross sectional view of an example implementation of a document acceptor 100. The document acceptor 100 can include a document validator 105 for authenticating received documents, a document cassette 110 with stacking mechanism 112 capable of storing documents in a stack configuration, a displacement actuator 115 that can change the position of the document cassette 110, and a chassis 120 that connects and secures the document validator 105 and the displacement actuator 115. The chassis 120 can house the document cassette 110 and can be adapted to allow insertion and removal of the document cassette. In some implementations, the displacement actuator 115 and the chassis 120 ensure proper alignment and positioning of the document cassette 110 for mating the document cassette 110 and the document validator 105. The chassis 120 can hold the document validator 105 and the displacement actuator 115 in a fixed position relative to one another. The document cassette 110 can be removable from the chassis 120 and FIG. 1 shows the document cassette 110 as partially inserted into the chassis 120.

Figure 2:
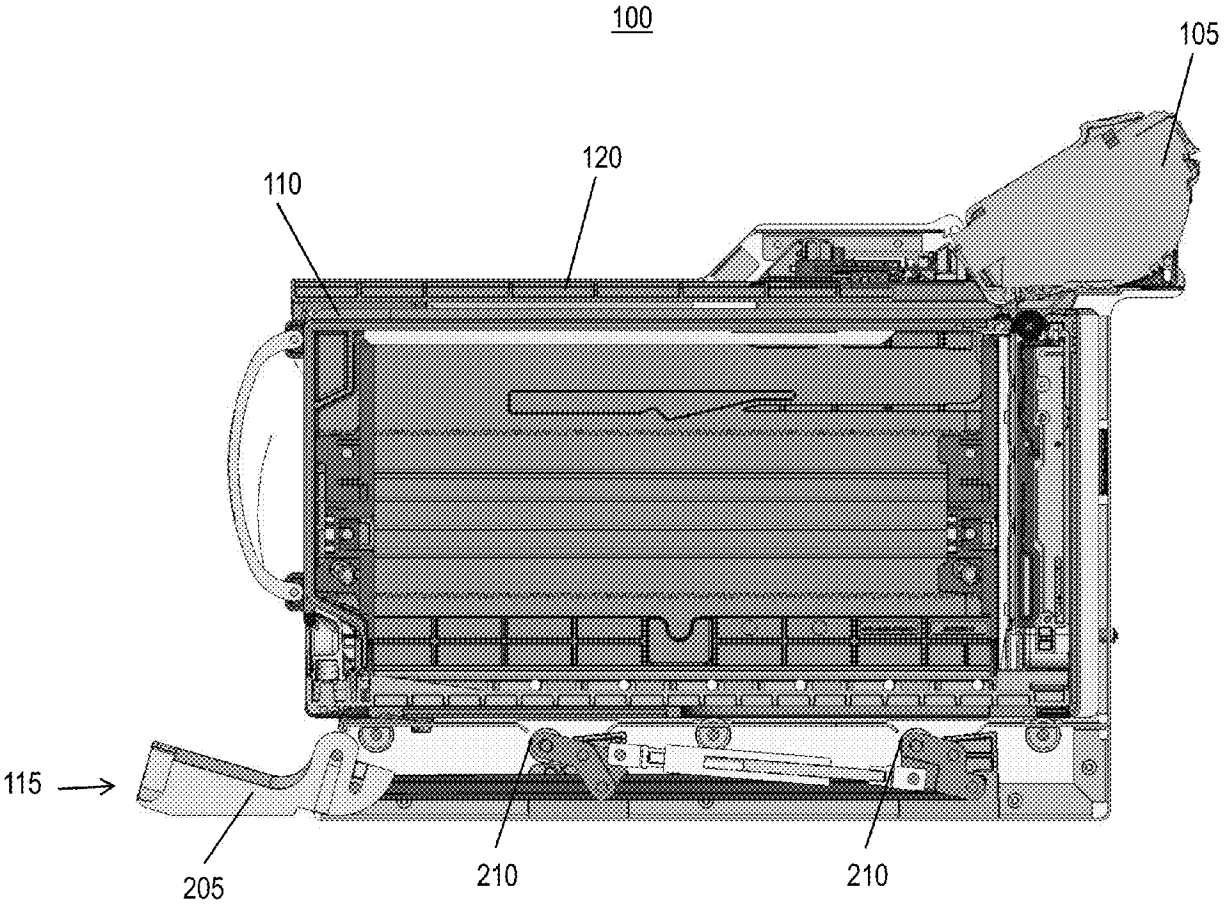
FIG. 2 is a cross sectional view of the example document acceptor with the document cassette fully inserted and the displacement actuator in the lowered position.
Figure 3:
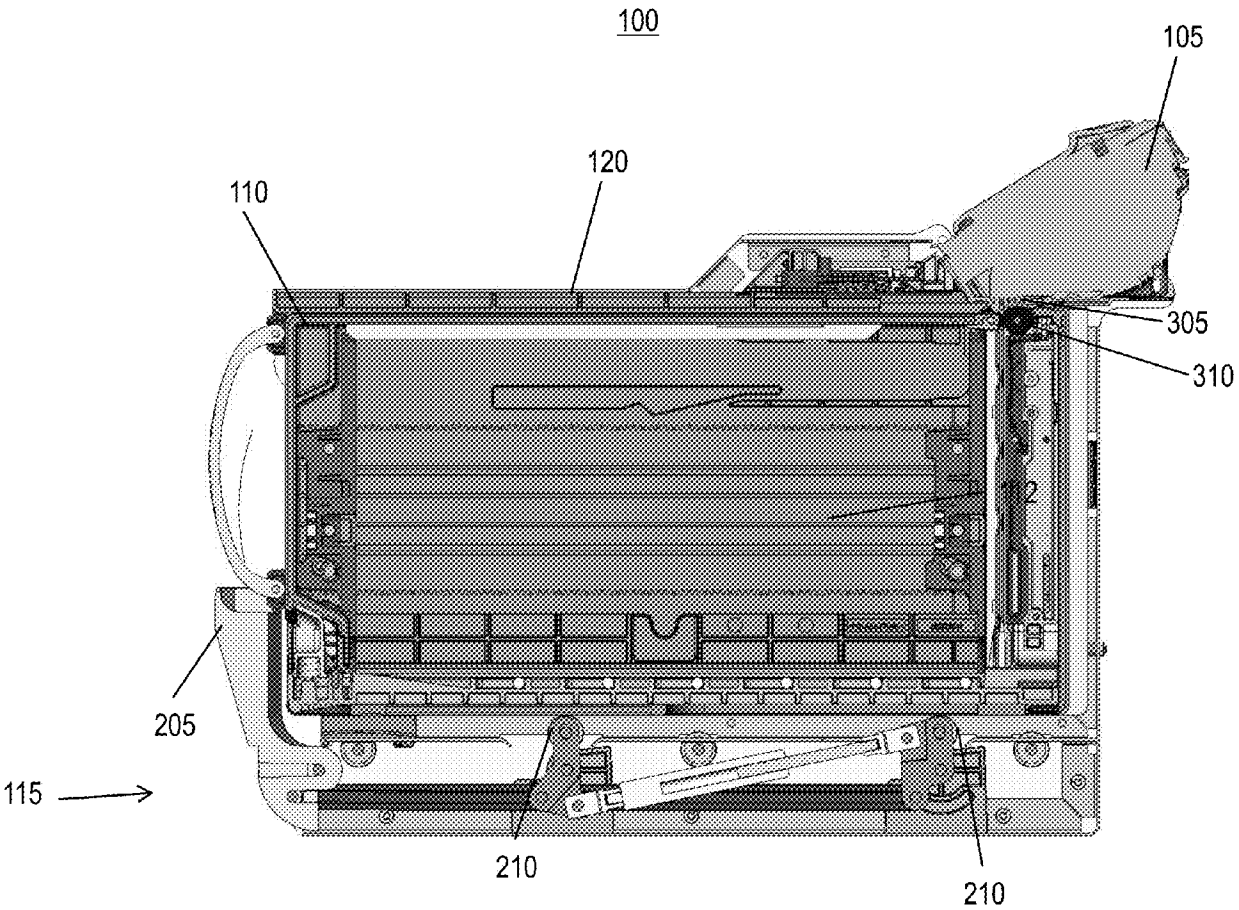
FIG. 3 is a cross sectional view of the example document acceptor with the document cassette fully inserted and the displacement actuator in the raised position.

The displacement actuator 115 can include a lever 205 (e.g., a handle) operatively coupled to one or more cams 210 that interface with the document cassette 110. In the implementation shown in FIG. 1, the displacement actuator 115 is in a lowered position and can, once the document cassette 110 is fully inserted in the horizontal direction, raise or lift the document cassette 110 in a vertical direction such that the document cassette 110 mates with the document validator 105. Specifically, rotation of the lever 205 by, for example, a user, can cause the cams 210 to rise thereby moving (e.g., lifting) the document cassette 110. For example, FIG. 2 is a cross sectional view of the document acceptor 100 with the document cassette 110 fully inserted and the displacement actuator 115 in the lowered position. FIG. 3 is a cross sectional view of the document acceptor 100 with the document cassette 110 fully inserted and the displacement actuator 115 in the raised position. The actuator 115 in the raised position has lifted the document cassette 110 and caused the document cassette 110 to mate with the document validator 105. In the implementation illustrated in FIGS. 1-3, the document cassette 110 and the document validator 105 mate when a validator gear 305 on the document validator 105 engages with a cassette gear 310 of the document cassette 110. Once the document cassette 110 and the document validator 105 mate, then normal operation of the document acceptor 100 can proceed (e.g., receiving, authenticating, and storing documents).

In the example implementation of the document acceptor 100, the validator gear 305 and/or the cassette gear 310 are projections that may be damaged by or would prevent the document cassette 110 from being inserted horizontally while the displacement actuator 115 is in the raised position. Thus, in the example implementation, vertical displacement is required to mate the document validator 105 and the document cassette 110.

Figure 4:
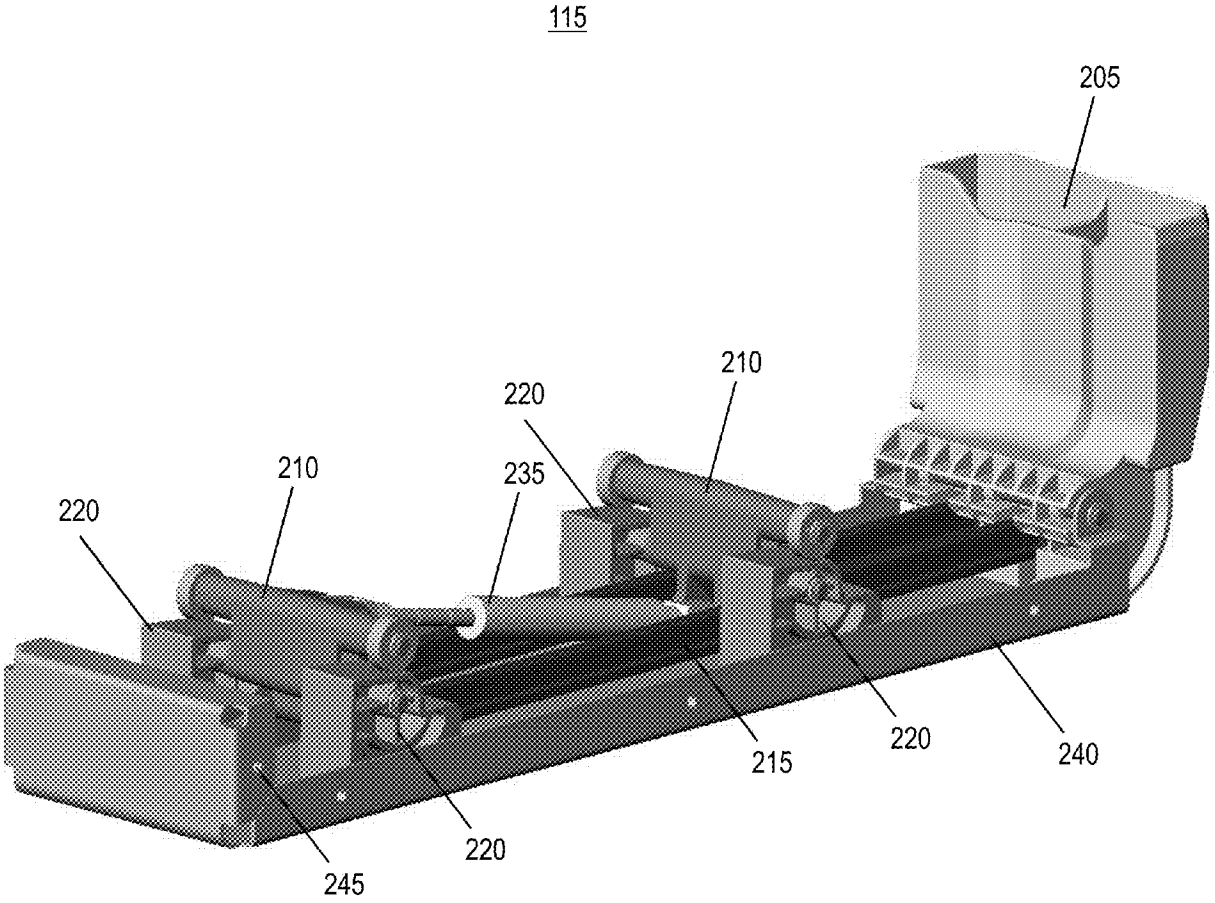
FIG. 4 is a perspective view of the example displacement actuator.
Figure 5A:
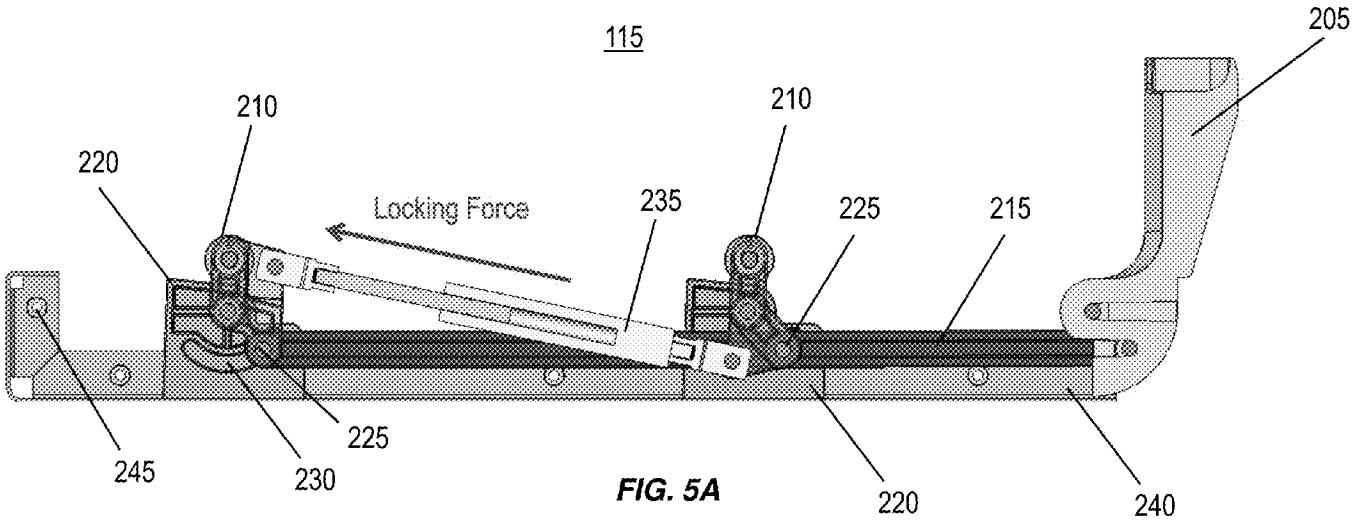
FIG. 5A is a cross sectional view of the displacement actuator in a raised position.
Figure 5B:
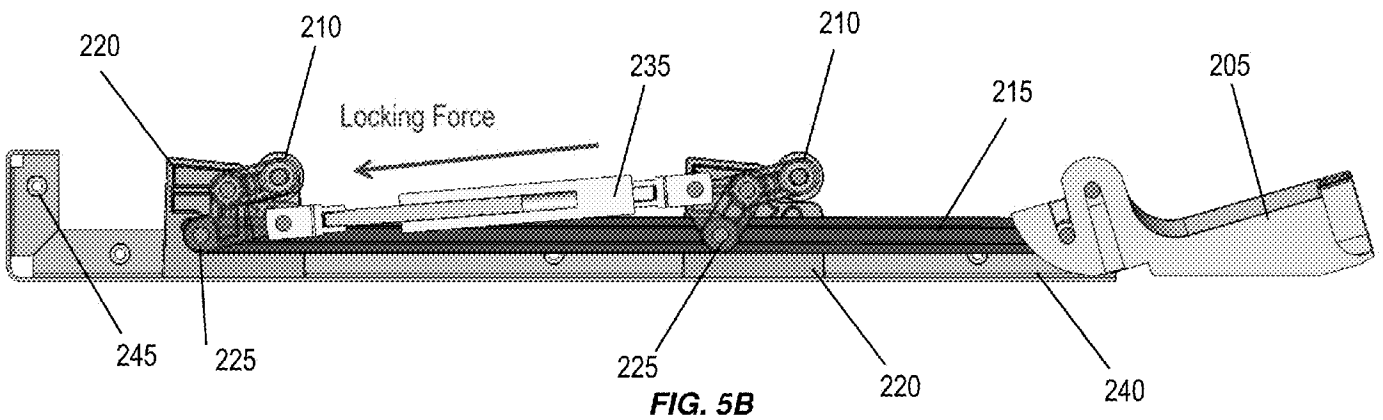
FIG. 5B is a cross sectional view of the displacement actuator in a lowered position.

FIG. 4 is a perspective view of the displacement actuator 115, FIG. 5A is a cross sectional view of the displacement actuator 115 in a raised position, and FIG. 5B is a cross sectional view of the displacement actuator 115 in a lowered position. The displacement actuator 115 can include a lever 205 (e.g., a handle), operatively coupled to cams 210 by rods 215 and brackets 220. Pins 225 on the rods 215 reside in recessed guides 230 on the brackets 220. Manipulation of the lever 205, for example, by pulling or pushing on lever 205 to rotate lever 205, causes the rods 215 to transition position (e.g., between positions illustrated in FIG. 5A and FIG. 5B) and transfer the motion to the cam 210, which in turn causes the cams 210 to raise or lower, respectively.

A bias mechanism 235 (e.g., a spring such as a gas spring) can connect cams 210 and can provide for a bias for locking the displacement actuator 115 (and a corresponding document cassette 110) in either the raised or the lowered position. The displacement actuator 115 can have two stable positions, either raised (e.g., FIG. 5A), or lowered (e.g., 5B). In other words, if the lever 205 is rotated such that the displacement actuator 115 is at a position that is between the raised and lowered position and force on the lever 205 is removed, then the displacement actuator, under bias from the bias mechanism 235, will return to one of the raised or lowered positions. In some implementations, the displacement actuator 115 provides for movement of the document cassette 110 solely in a single axis (e.g., vertical, horizontal, and the like).

The bias mechanism 235 can also allow the displacement actuator 115 to self-adjust the final raised position such that the final raised position (e.g., FIG. 5A) is independent of a final position of the lever 205. Such self-adjustment can be necessary to compensate for manufacturing tolerances in any of the document cassette 110, document validator 105, and chassis 120. Thus, the lever 205 can rotate through a predefined range of motion while the range of lift or lowering of the document cassette 110 can vary between different document cassettes, document validators 105, and chassis 120. In one example implementation, the displacement actuator 115 can provide up to a 9-millimeter position displacement (e.g., lift).

In an example implementation, substantially the same amount of force (e.g., constant) is required on the lever 205 in order to manipulate the displacement actuator 115 between lowered and raised positions regardless of the weight of the document cassette 110. In other words, components displacement actuator 115 can serve as an assist mechanism so that a relatively large change in weight of the document cassette 110 results in a relatively small change in the required force applied to the lever 205 to lift or lower the document cassette 110. The weight of the document cassette 110 can vary depending on content of the document cassette 110, such as whether the document cassette 110 is empty or full of documents.

The displacement actuator 115 can include a housing 240 with one or more removably securing features 245 for fastening or securing the displacement actuator 115 to the chassis 120 (e.g., via screws, bolts, and the like). By being removable from the chassis 120, the displacement actuator 115 can be serviceable without requiring disassembly of the entire document acceptor 100.

Figure 6:
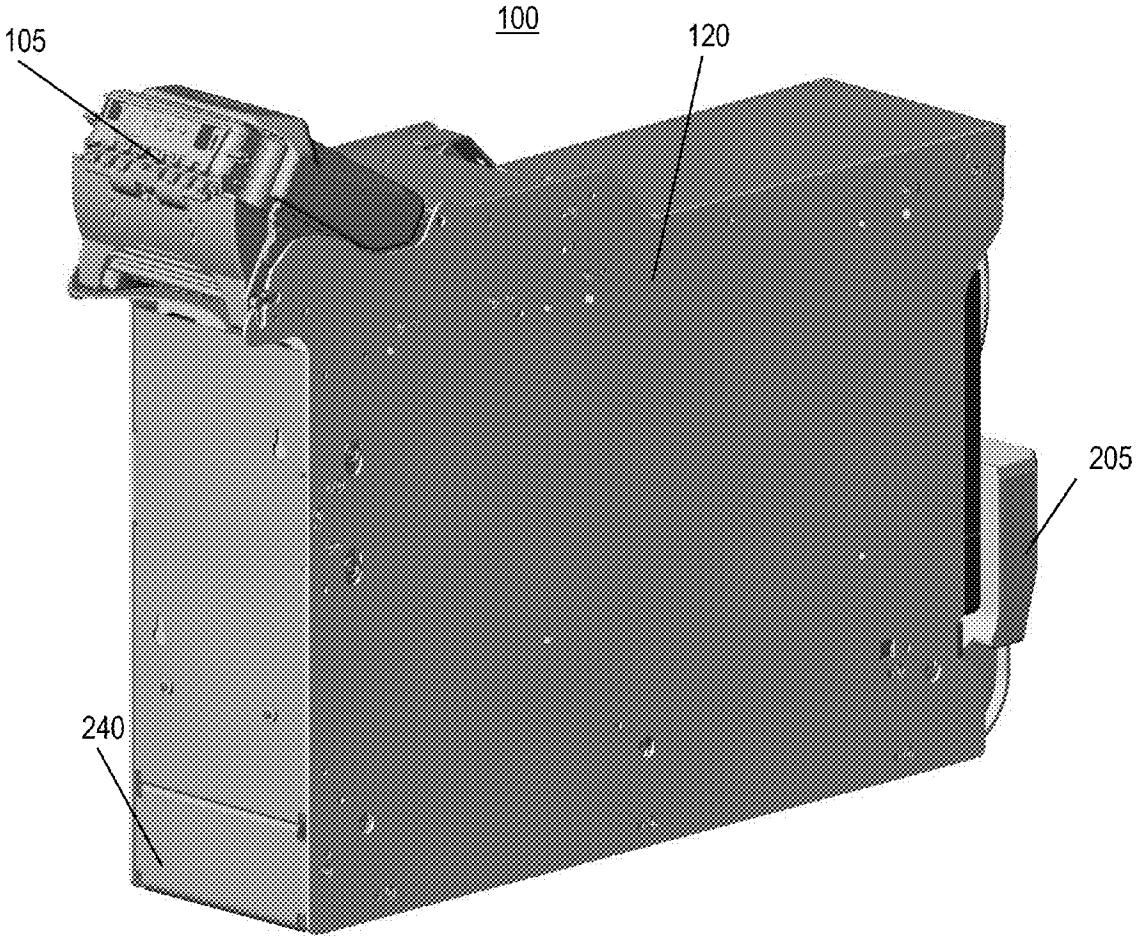
FIG. 6 is a perspective view of the example implementation of a document acceptor.

FIG. 6 is a perspective view of the example implementation of a document acceptor 100. Chassis 120 secures the document validator 105 with the displacement actuator 115 and houses the document cassette 110.

Figure 7:
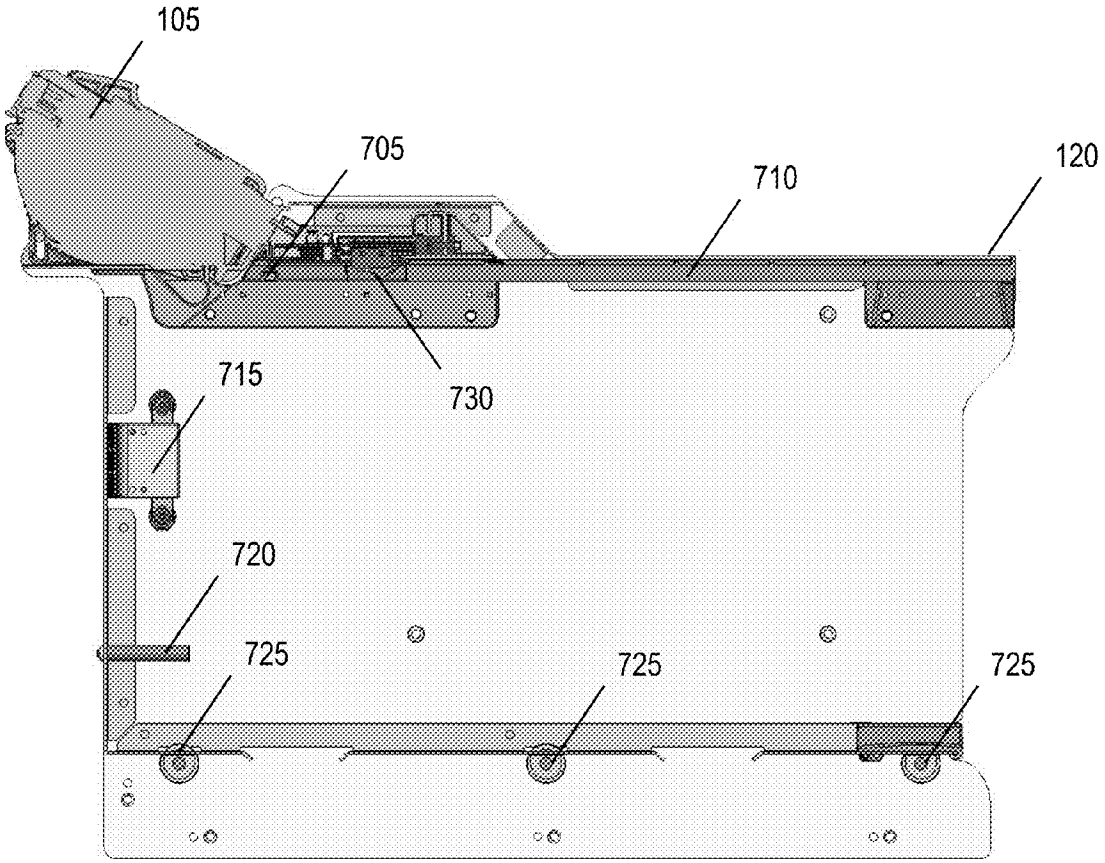
FIG. 7 is a cross sectional view of a chassis containing document validator with the document cassette and the displacement actuator removed.
Figure 8:
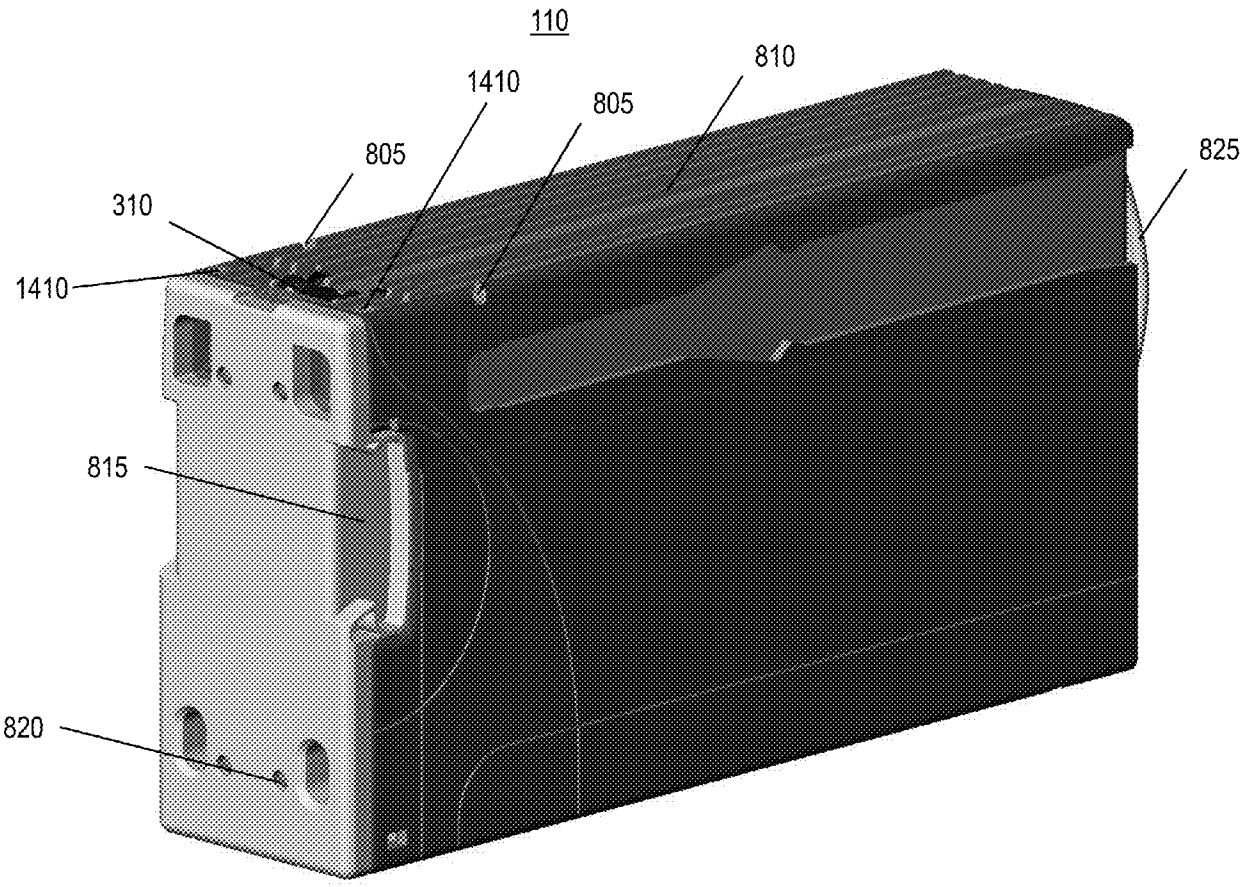
FIG. 8 is a perspective view of an example implementation of a document cassette.
Figure 9:
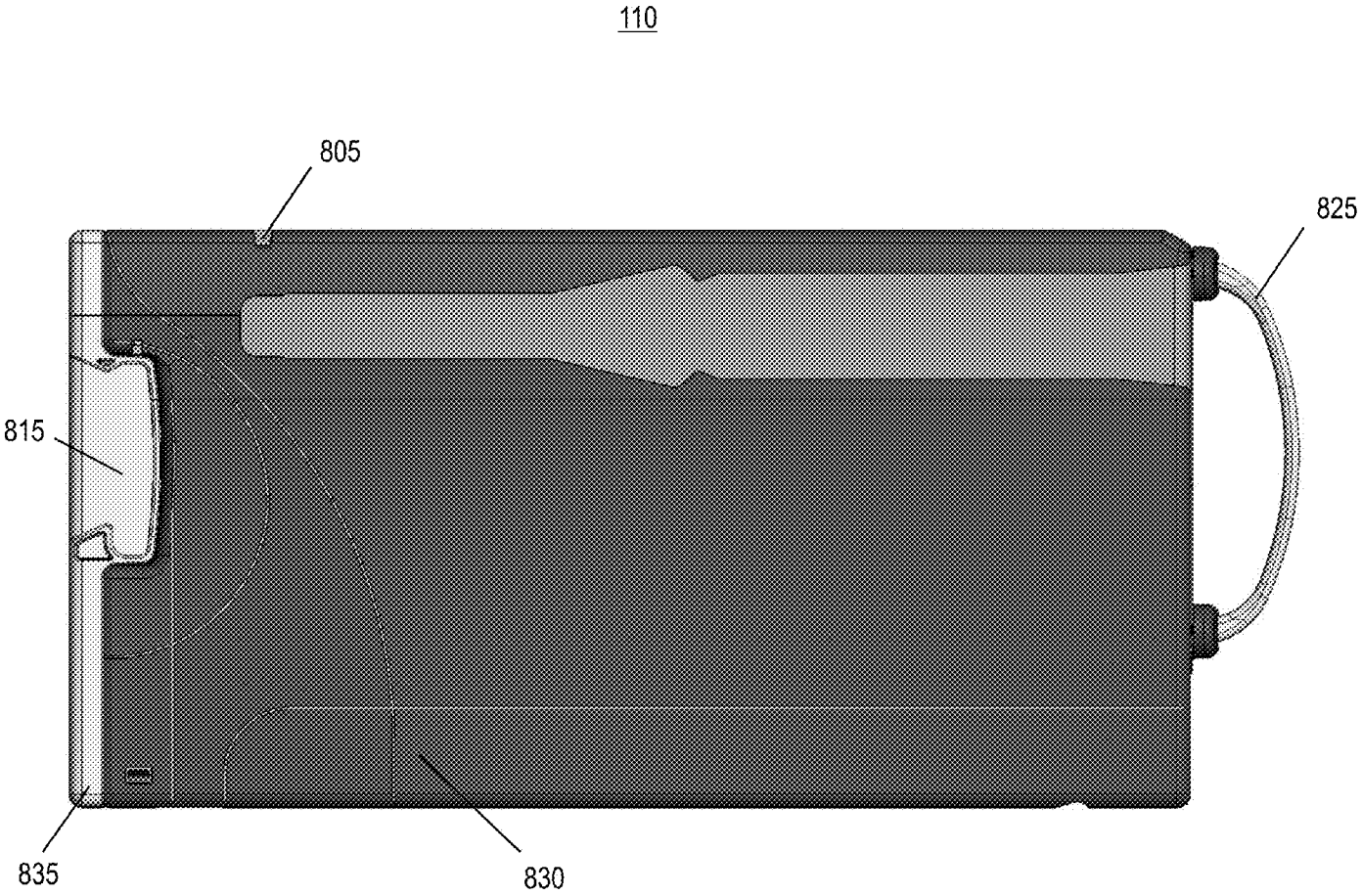
FIG. 9 is a side view of the example implementation of the document cassette.
Figure 10A:
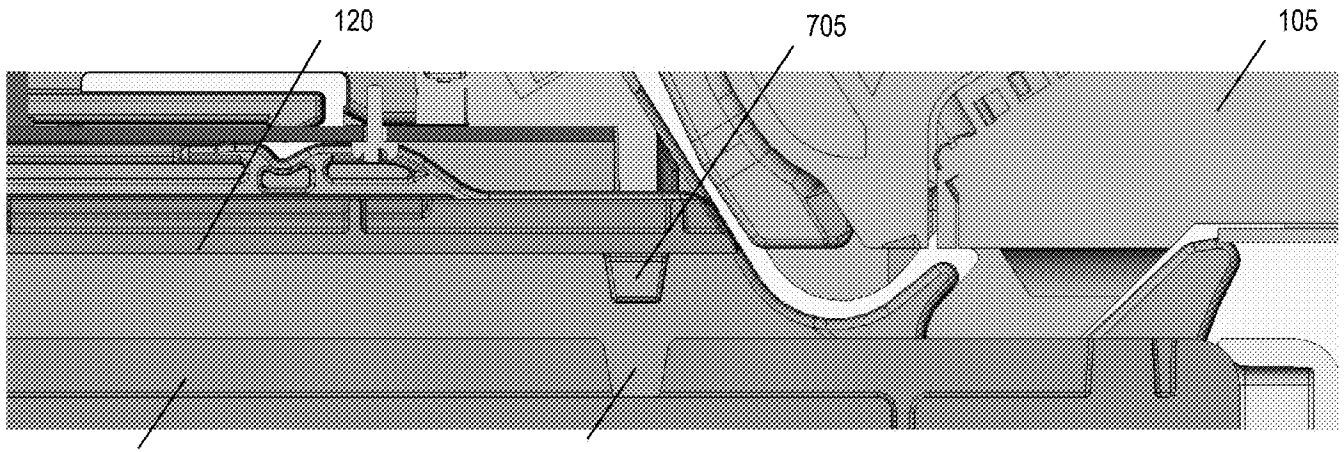
FIG. 10A is a close up view of the horizontal alignment lock features and corresponding cassette horizontal alignment lock features with the document cassette and displacement actuator in a lowered position.
Figure 10B:
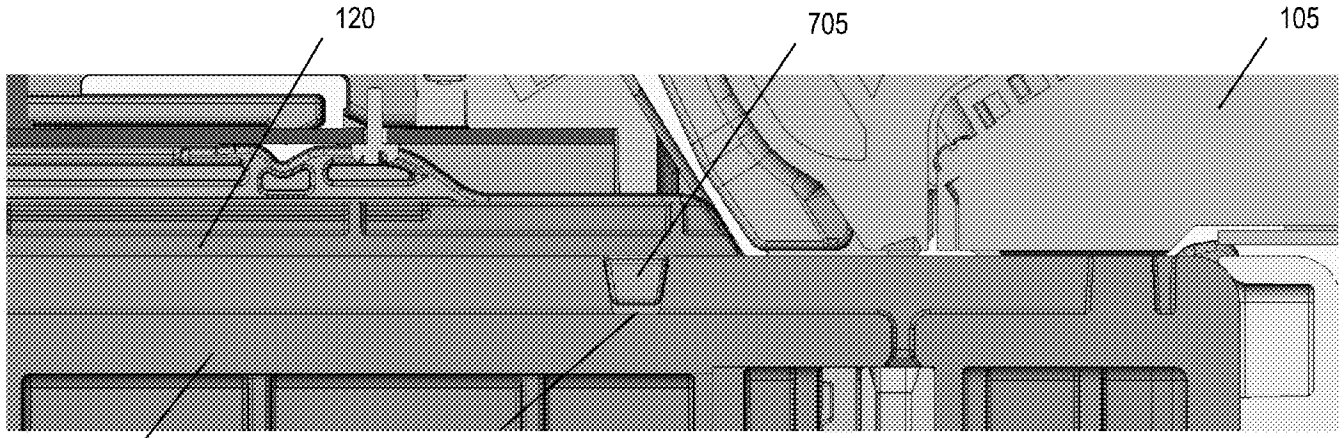
FIG. 10B is a close up view of the horizontal alignment lock features and corresponding cassette horizontal alignment lock features with the document cassette and displacement actuator in a raised position.

FIG. 7 is a cross sectional view of a chassis 120 containing document validator 105 with the document cassette 110 and the displacement actuator 115 removed. FIG. 8 and FIG. 9 are a perspective view and a side view, respectively, of an example implementation of a document cassette 110. The chassis 120 can include horizontal alignment lock features 705 that can include a projection and can aid in proper positioning of the document cassette 110 when the document cassette 110 mates with the document validator 105. The document cassette 110 can include corresponding horizontal alignment lock features 805 that can include a recess. When the document cassette 110 is inserted into the chassis 120, the horizontal alignment lock features 705 and corresponding cassette horizontal alignment lock features 805 can serve to prevent mating of the document cassette 110 and the document validator 105 unless the document cassette 110 is fully inserted into the chassis 120. When the document cassette 110 fully inserts into the chassis 120, the horizontal alignment lock features 705 and corresponding cassette horizontal alignment lock features 805 align allowing the displacement actuator 115 to lift the document cassette 110 a sufficient distance to allow for the document cassette 110 and the document validator 105 to mate. For example, FIG. 10A is a close up view of the horizontal alignment lock features 705 and corresponding cassette horizontal alignment lock features 805 with the document cassette 110 and displacement actuator 115 in a lowered position. The document cassette 110 is fully inserted into the chassis 120. When the displacement actuator 115 lifts the cashbox 110, the document cassette 110 and the document validator 105 can engage because the document cassette 110 is fully inserted. FIG. 10B is a close up view of the horizontal alignment lock features 705 and corresponding cassette horizontal alignment lock features 805 with the document cassette 110 and displacement actuator 115 in a raised position.

Figure 11B:
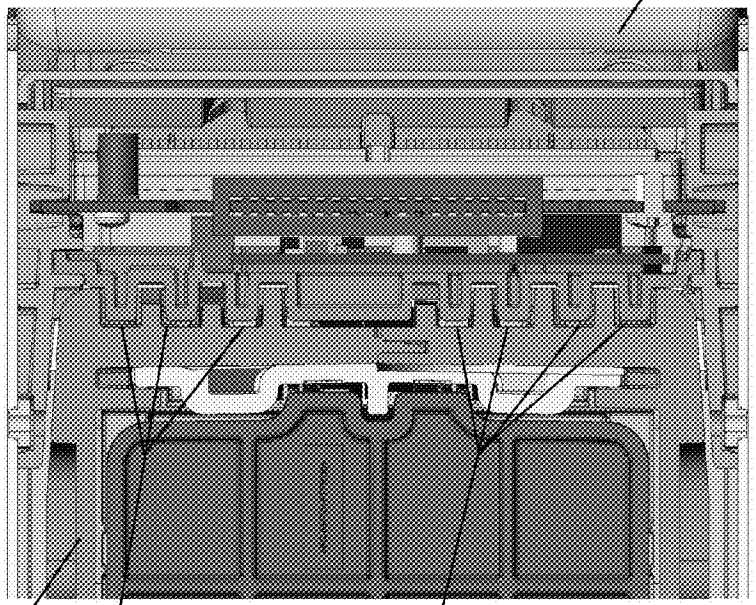
FIG. 11B is a cross section view of the alignment rails and corresponding alignment rail features with the displacement actuator and the document cassette in a raised position.
Figure 11A:
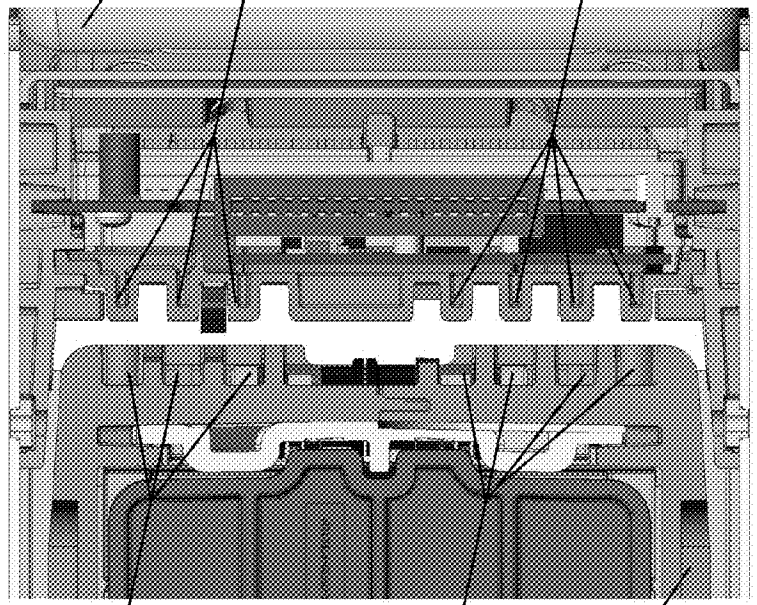
FIG. 11A is a cross section view of the alignment rails and corresponding alignment rail features with the displacement actuator and the document cassette in a lowered position.

Referring again to FIGS. 7-9, the chassis 120 can include alignment rails 710 and the document cassette 110 can include corresponding alignment rail features 810 for ensuring that the document cassette 110 is laterally aligned when inserted into the chassis 120. FIG. 11A is a cross section view of the alignment rails 710 and corresponding alignment rail features 810 with the displacement actuator 115 and the document cassette 110 in a lowered position. FIG. 11B is a cross section view of the alignment rails 710 and corresponding alignment rail features 810 with the displacement actuator 115 and the document cassette 110 in a raised position. The alignment rails 710 and corresponding alignment rail features 810 are engaged to allow the document cassette 110 to mate with the document validator 105.

Referring again to FIGS. 7-9, the chassis 120 can include a forward lock feature 715 for locking the document cassette 110 in a fully inserted position. The forward lock feature 715 can soft lock a fully inserted document cassette 110 when the displacement actuator 115 and the document cassette 110 are in the lowered position. A soft lock can provide some resistance to removing the document cassette 110 (e.g., so the document cassette 110 does not inadvertently slide out of the chassis 120) but not so much resistance that the document cassette 110 cannot be removed without damaging the document acceptor 105. The forward lock feature 715 can also hard lock a fully inserted document cassette 110 when the displacement actuator 115 and the document cassette 110 are in the raised position. A hard lock can prevent removal of the document cassette 110 without also damaging the document acceptor 100. The document cassette 110 can include a corresponding forward lock feature 815 or recess for engaging the forward lock feature 715 of the chassis 120.

Figure 12C:
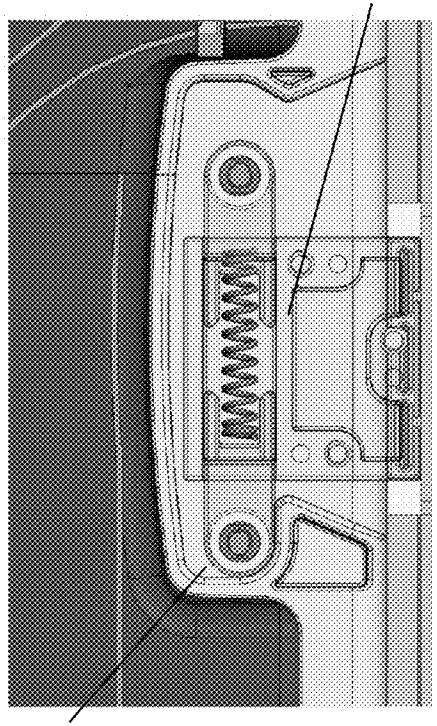
FIGS. 12A-C illustrate engagement of the forward lock feature and the corresponding cassette forward lock feature.
Figure 12B:
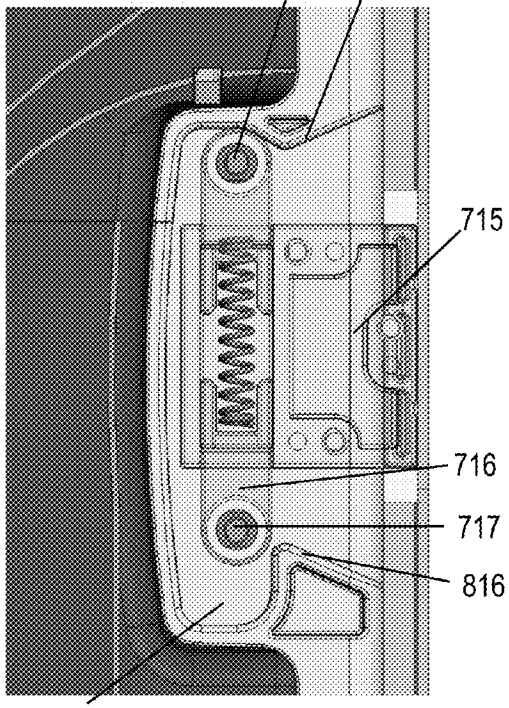
Figure 12A:
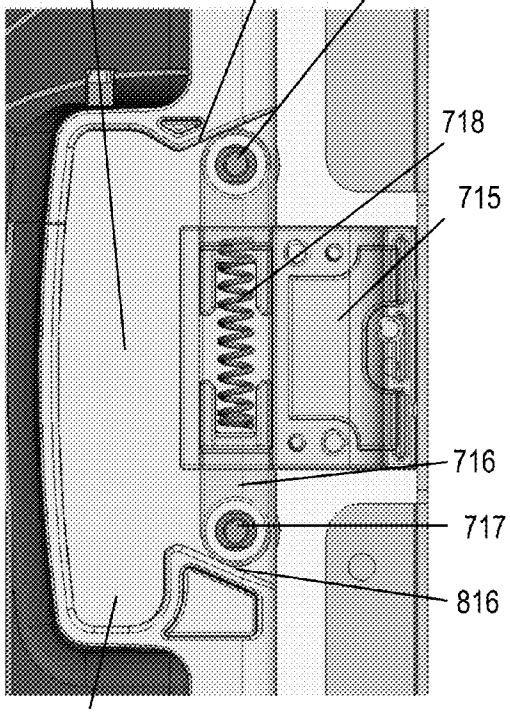

FIGS. 12A-C illustrate engagement of the forward lock feature 715 and the corresponding cassette forward lock feature 815. The forward lock feature 715 can include an adjustable-length telescoping arm 716 having two projecting lock pins 717 or bearings near the ends of the arm 716. A spring 718 within the arm 716 can bias the arm 716 to full extension. The cassette forward locking feature 815 can include a recess pocket 818.

At FIG. 12A, the document cassette 110 inserts into the chassis 120 but is not fully inserted. The document cassette 110 and the displacement actuator 115 are in the lowered position. As the document cassette 110 inserts, ramps 816 on the cassette forward locking features 815 serve to push together the lock pins 717 shortening the arm 716. Once the arm 716 has cleared the ramps 816, the arm 716 can fully extend, as shown at FIG. 12B. Reverse ramps 817 provide some resistance to the forward locking feature 715 so that the document cassette 110 is soft-locked into the chassis 120. Should there be an attempt to remove the document cassette 120, the lock pin 717 near the reverse ramp 816 would ride the reverse ramp 816 and release the document cassette 110 from the forward lock feature 715. At FIG. 12C, the document cassette 110 and displacement actuator 115 is in the raised position. The arm 716 and a lock pin 717 reside within the recess pocket 818 and the cassette forward locking feature 815 can block the arm 716 and lock pin 717 to prevent removal of the document cassette 120 from the chassis 120. In order for the document cassette 110 to be removed from the chassis 120, the document cassette 110 and displacement actuator 115 can first transition to the lowered position (e.g., FIG. 12B), then the document cassette 110 can be removed.

In some implementations, the document cassette 110 can include a stacking mechanism 112. During normal document acceptor 100 operations, when document validator 105 receives and authenticates a document, the document travels through document validator 105 to document cassette 110 where the stacking mechanism 112 places the document onto a stack of documents. While stacking the document, the stacking mechanism 112 can impart a force directed generally rearward with respect to the document acceptor 100. The forward lock feature 715 and the corresponding cassette forward lock feature 815 can serve to prevent the document cassette 110 from becoming unaligned or unmated from the document validator 105 because of the forces from the stacking mechanism 112.

The forward lock feature 715 and the corresponding cassette forward lock feature 815 can also serve to provide feedback to a user that the document cassette 110 is fully inserted into the document acceptor 100 because the user can test whether the soft-lock is engaged.

Figure 13:
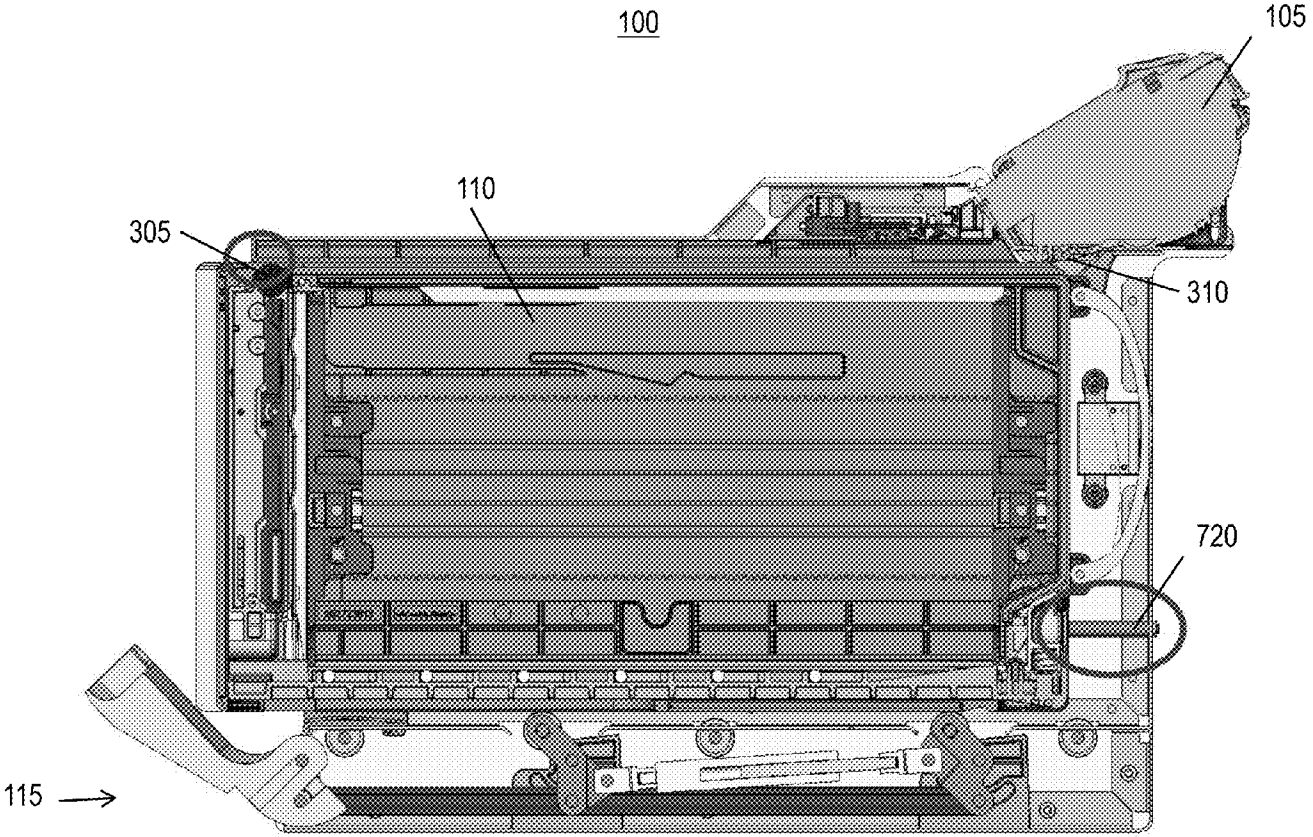
FIG. 13 is an illustration of the document acceptor with the document cassette improperly inserted backwards into the chassis.

Referring again to FIGS. 7-9, the chassis 120 can include a cassette stop 720. The document cassette 110 can include a corresponding cassette stop recess 720 for mating with the cassette stop 720. The cassette stop 720 can prevent full insertion of, for example, the wrong type of document cassette 110, or insertion of the document cassette 110 in the wrong orientation (e.g., backwards). For example, FIG. 13 is an illustration of the document acceptor 100 with the document cassette 110 improperly inserted backwards into the chassis 120. The cassette stop 720 prevents the improper insertion from damaging the document validator gear 310 and the document cassette gear 305. Moreover, preventing full insertion of the document cassette 110 into the chassis 120 provides a visual indication (to, for example, a service personnel) that the document cassette 110 is improperly inserted and normal operation of the document acceptor 105 cannot begin.

Referring again to FIGS. 7-9, the chassis 120 can further include one or more wheels 725 as a low-friction riding surface for the document cassette 110 to enable easy and smooth insertion and removal of the document cassette 110 from the chassis 120. Additionally, the document cassette 110 can include a handle 825 for insertion and removal of the document cassette 110. The document cassette 110 can comprise a storage box 830 and a faceplate 835 containing the cassette forward stop features 815. The box 830 may be for use with a different implementation of a document acceptor and can be retrofitted by addition of the faceplate 835, although other implementations of the document cassette 110 are possible.

Figure 14A:
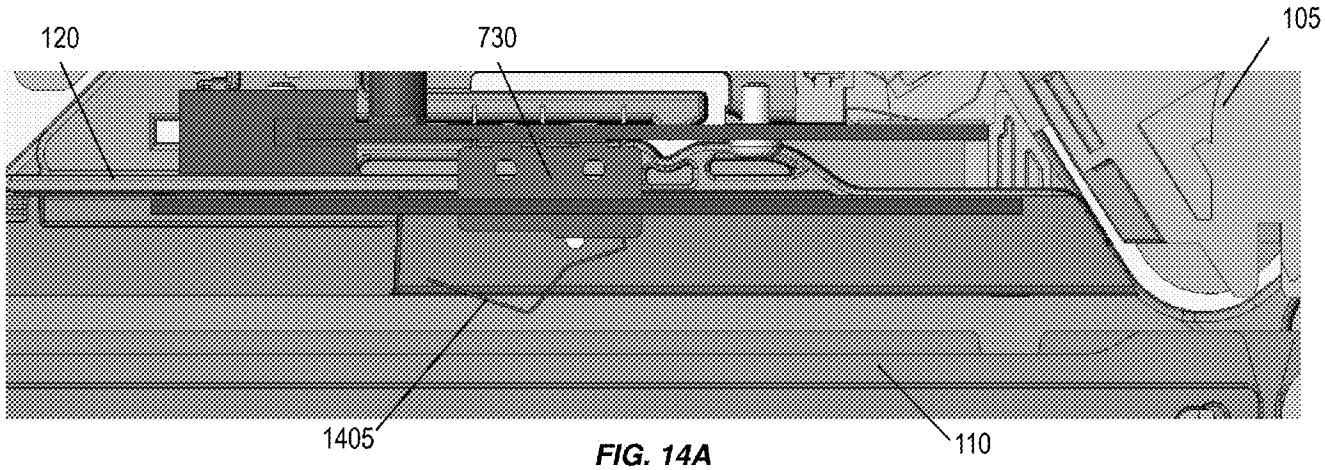
FIG. 14A is a cross section view of an example implementation of a cassette detection unit.
Figure 14B:
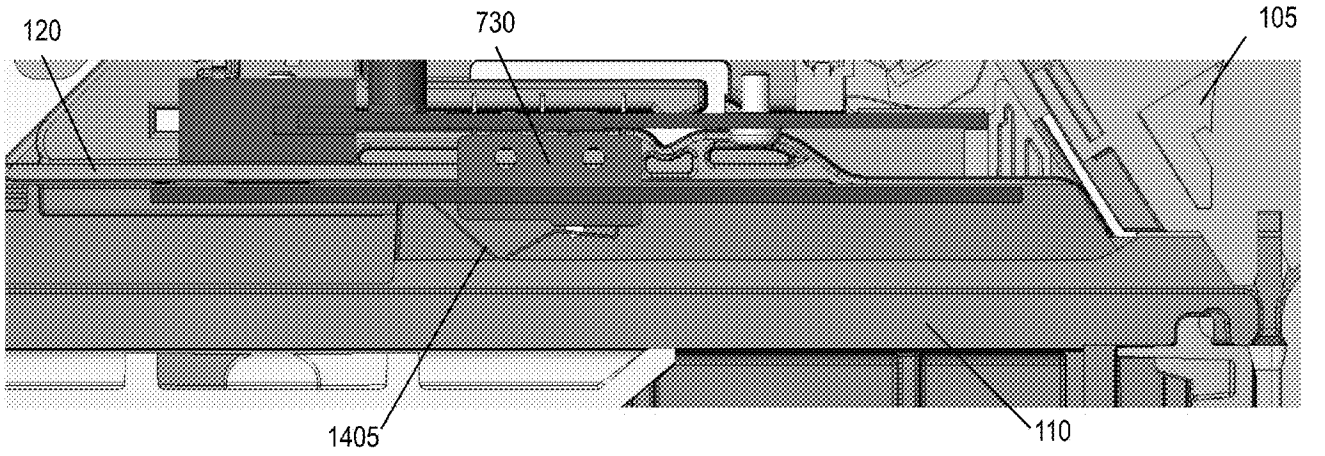
FIG. 14B is a cross section view of the cassette detection unit with the document cassette and displacement actuator in the raised position.

The chassis 120 can further include a cassette detection unit 730 to detect whether the document cassette 110 has mated with the document validator 105. The cassette detection unit 730 can detect horizontal position and vertical position of the document cassette 110. FIG. 14A is a cross section view of an example implementation of a cassette detection unit 730. The document cassette 110 and displacement actuator 115 is in a lowered position. FIG. 14B is a cross section view of the cassette detection unit 730 with the document cassette 110 and displacement actuator 115 in the raised position. The cassette detection unit 730 can include a mechanical switch 1405, which can be triggered when the document cassette 110 and the displacement actuator 115 are in the raised position, thus detecting that the document cassette 110 and the displacement actuator 115 are raised. A light guide 1410 (e.g., illustrated in FIG. 8) may be included for detecting horizontal position of the document cassette 110. When the document cassette 110 obstructs light guide 1410, the document cassette 110 can be detected as being fully inserted.

The cassette detection unit 730 can be operably coupled to the document validator 105 and the document validator 105 can use the information gained from the cassette detection unit 730 to determine whether the document cassette 110 is properly mated to the document validator 105. An indicator (such as a light, sound, electronic transmission, and the like) can be generated when the document cassette 110 is detected as being properly mated to the document validator 105. Moreover, document validator 105 can use the information gained from the cassette detection unit 730 to determine whether the document acceptor 100 may proceed with normal operation (e.g., receiving, authenticating, and storing documents).

FIGS. 15-19 are cross sections of another example implementation of a document acceptor 1500 having a displacement actuator 1515 that allows for over-rotation of a handle 1520 (e.g., extra travel). In the example implementation of FIGS. 15-19, the displacement actuator 1515 includes a handle 1520 having clutch features 1525 that allow for over-rotation of the handle 1515. The handle 1520 also includes a hook 1530 that engages with a rotation stop 1535 to prevent the handle 1520 from rotating past a predetermined range of motion.

Figure 15:
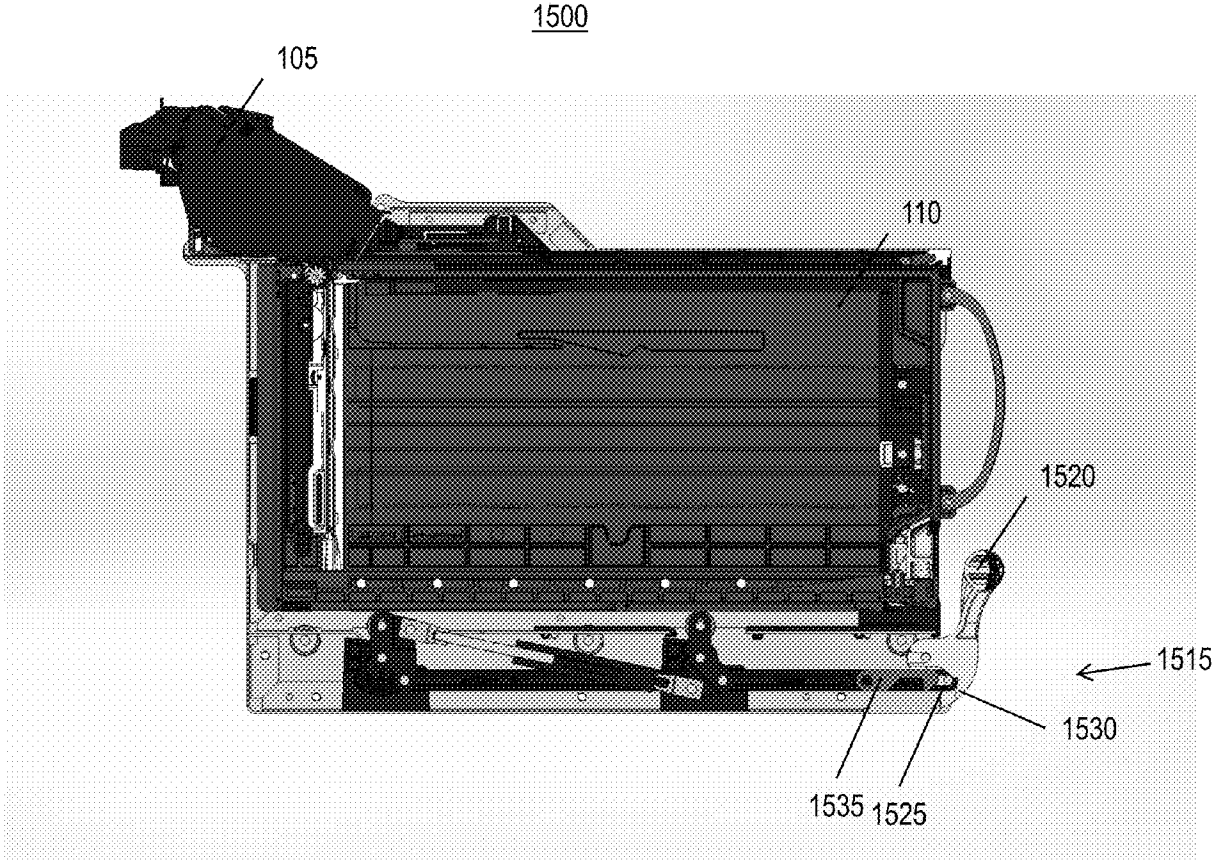
FIGS. 15-19 are cross sections of another example implementation of a document acceptor having a displacement actuator that allows for over-rotation of a handle.
Figure 16:
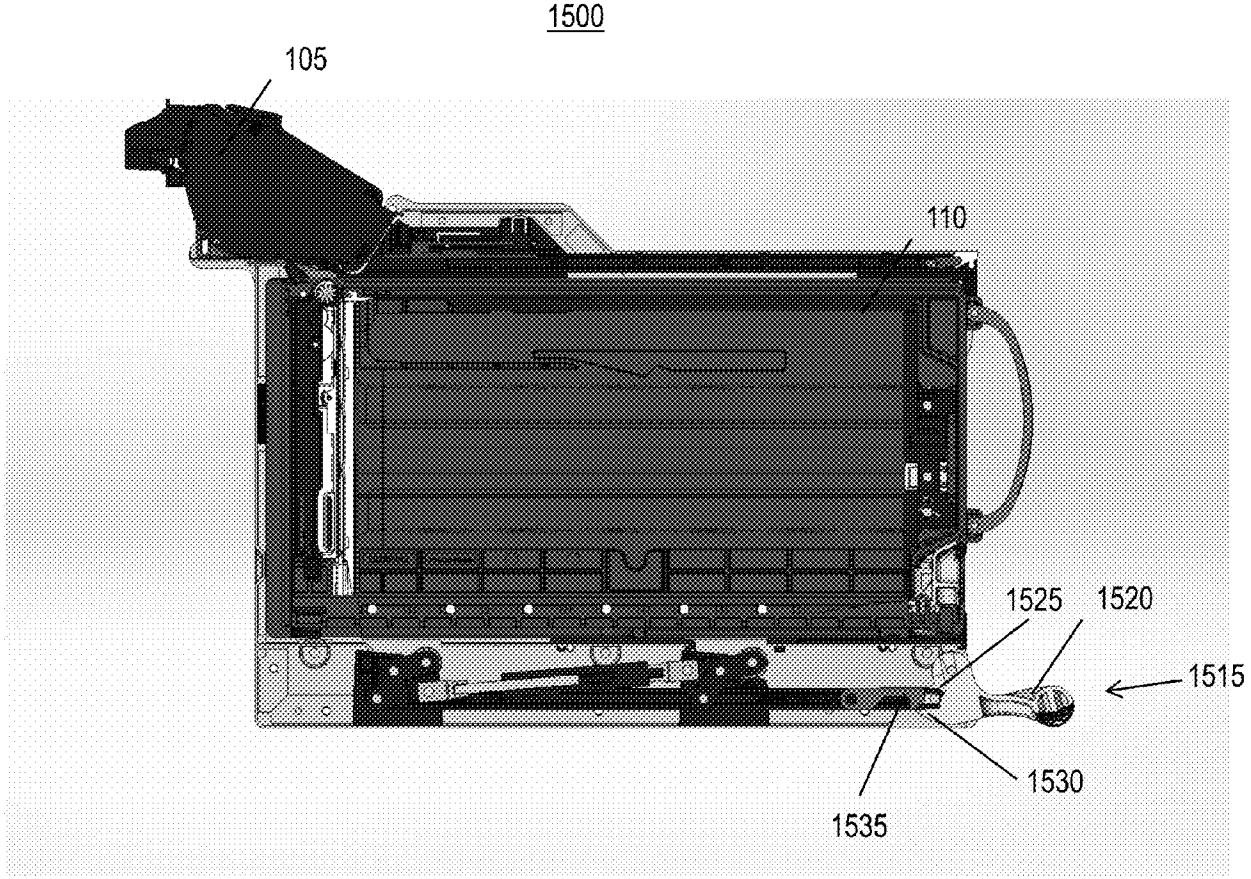

FIG. 15 illustrates the displacement actuator 1515 in a raised position with handle 1520 substantially vertical (e.g., approximately perpendicular to ground level). FIG. 16 illustrates the displacement actuator 1515 in a lowered position with handle 1520 substantially horizontal (e.g., approximately parallel to ground level). The document cassette 110 can be removed from the document acceptor 1500. Moreover, by returning the displacement actuator 1515 to the lowered position when the handle 1520 is above or substantially parallel to ground level (e.g., horizontal), the displacement actuator 1515 can be operated while the document acceptor 1500 rests on the ground.

Figure 17:
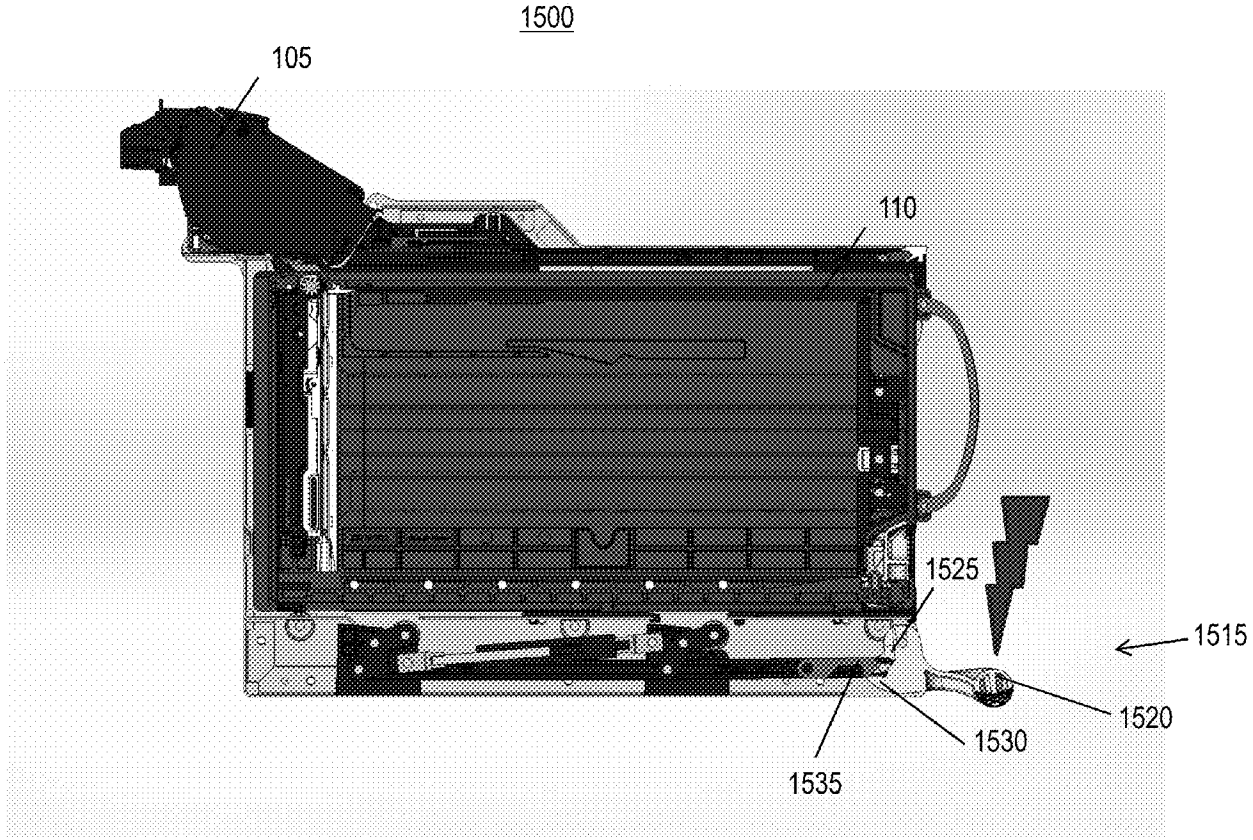
Figure 18:
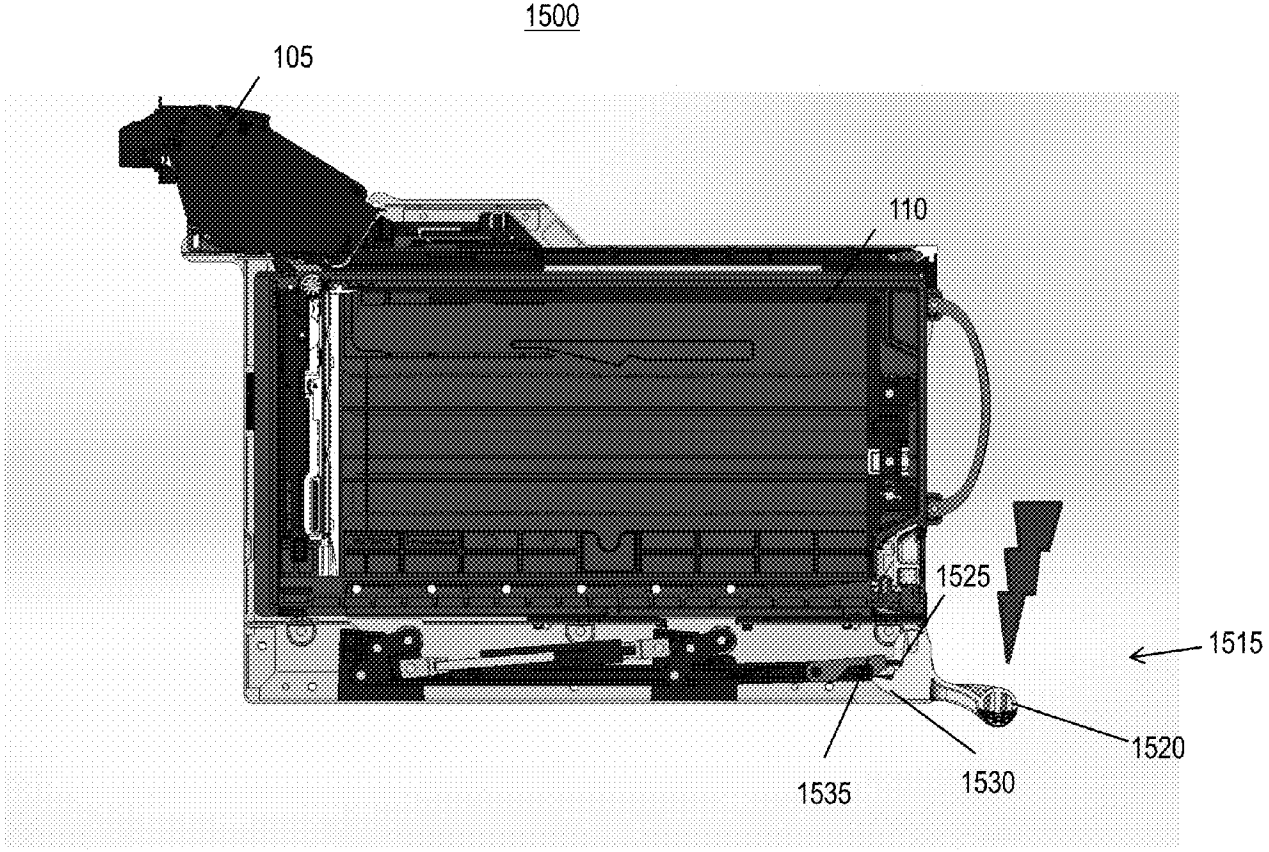
Figure 19:
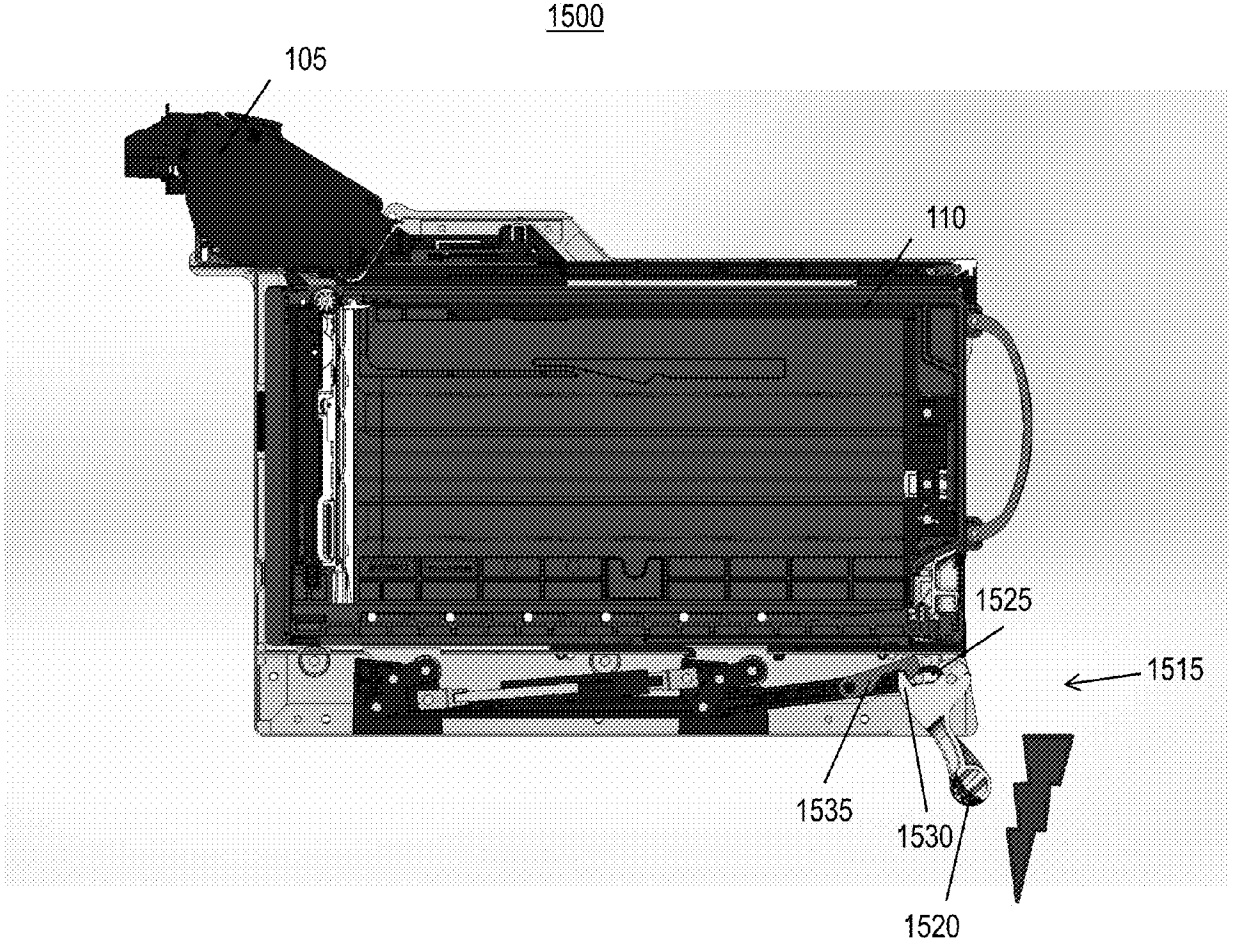

FIG. 17 illustrates the handle 1520 over-rotated beyond the normal operating range of permitted motion (e.g., beyond parallel to ground level). Clutch feature 1525 is ready to engage and allow for further rotation of the handle 1520 without damage to the displacement actuator 1500. FIG. 18 illustrates the handle 1520 even further over-rotated and the clutch feature 1525 is engaged. This may occur, for example, if an individual steps on the handle 1515 or too much force is applied to the handle 1515. FIG. 19 illustrates that, after full over-rotation, hook 1530 on the handle 1520 engages with rotation stop 1535 to prevent further rotation of the handle 1520. As illustrated in FIG. 19, the maximum over-rotation allowed in the example implementation is approximately perpendicular to ground level (e.g., a safe position). The allowed over-rotation can serve to protect the displacement actuator 1500 should the handle 1515 over-rotate.

The subject matter described herein provides many advantages. For example, document cassette access from different orientations is achieved. Motion to mate the document cassette with the document validator can occur with a single motion and projections or features (e.g., on the document validator or document cassette) can be protected or clearance for the projections or features can be provided. Existing document acceptors can be retrofit without modifying the document validator (or head). The current subject matter can enable feedback to a user that a document cassette is fully inserted and mated with the document acceptor. Adjustment by the displacement actuator can account for variable height and manufacturing tolerances.

As described herein, documents can include banknote, bills, checks, valuable papers, currency, coins, tokens, certificates, coupons, tickets, valuable items, and the like.

While the example implementation of the displacement actuator 115 has been described herein as including a lever or handle, other implementations are possible. For example, the displacement actuator can include an electric motor for moving the document cassette to mate with the document validator (e.g., an "elevator"). Moreover, the movement can be from any direction or orientation (e.g., vertical, horizontal, and/or other), in a single direction or along any predetermined trajectory including rotational movement (e.g., rotating the document cassette into mating position with the document validator).

In some implementations, the current subject matter can provide for document cassette 110 access from different orientations (e.g., other than or in addition to the rear). For example, the document acceptor 100 can be adapted to allow a document cassette to insert from multiple orientations, such as from either the front or the rear with a document cassette having multiple handles. In some implementations, the displacement actuator can move the document validator 105 to mate with a stationary document cassette 110, or both the document validator 105 and the document cassette 110 can move to provide for proper mating. Other implementations are possible.

Although a few variations have been described in detail above, other modifications are possible. For example, the implementations described above can be directed to various combinations and subcombinations of the disclosed features and/or combinations and subcombinations of several further features disclosed above. In addition, the logic flows described herein do not require the particular order, or sequential order, to achieve desirable results. Other embodiments may be within the scope of the following claims.

What is claimed is:

1. A document acceptor for authenticating and storing documents, the document acceptor comprising:

a document validator configured to authenticate received documents;

a document cassette configured to store the documents received by the document validator; and a displacement actuator including a housing, a lever, and a cam operatively coupled to the lever, wherein rotation of the lever causes the cam to transition between a first cam position and a second cam position, wherein the cam is configured to interface with the document cassette when moving to the second cam position to change a position of the document cassette from a first position to a second position to mate the document cassette with the document validator, wherein the housing is adapted to removably secure the displacement actuator to a document acceptor, and wherein the housing is held in a fixed position relative to the document validator while the position of the document cassette is changed.

2. The document acceptor of claim 1, wherein actuation of the lever causes the displacement actuator to change the position of the document cassette from the first position to the second position to mate the document cassette with the document validator.

3. The document acceptor of claim 2, wherein actuation of the lever through a predetermined range of motion causes the displacement actuator to change the position of the document cassette to the second position, wherein the second position varies based on a position of the document validator.

4. The document acceptor of claim 1, further comprising a chassis coupling the document validator and the displacement actuator, the chassis adapted to allow insertion and removal of the document cassette in a first direction.

5. The document acceptor of claim 1, wherein the displacement actuator is adapted to lift the document cassette in a vertical direction from the first position to the second position.

6. The document acceptor of claim 1, further comprising a chassis coupling the document validator and the displacement actuator.

7. The document acceptor of claim 1, further comprising a chassis coupling the document validator and the displacement actuator, the displacement actuator including a housing being removably secured to the chassis.

8. The document acceptor of claim 1, wherein the first position is an initial position and the second position is a final position, wherein the displacement actuator is adapted to cause the position of the document cassette to change to the initial position or the final position when the position of the document cassette is not the initial position or the final position.

9. The document acceptor of claim 1, wherein the displacement actuator includes the lever for actuation and an assist mechanism that provides mechanical advantage such that changing the position of a document cassette containing documents requires substantially the same amount of force on the lever as changing the position of a document cassette that is empty of documents.

10. The document acceptor of claim 1, further comprising a cassette detection unit adapted to detect whether the document cassette is mated with the document validator.

11. The document acceptor of claim 1, further comprising a chassis and the document cassette includes features adapted to soft lock the document cassette to the chassis when the displacement actuator is in a down position and the document cassette can be removed, the features further adapted to lock the document cassette to the chassis when the displacement actuator is in an up position and the document cassette is mated to the document validator.

12. The document acceptor of claim 1, the document validator having one or more gear projections preventing solely horizontal insertion of the document cassette into a mating position with the document validator.

13. The document acceptor of claim 1, wherein the displacement actuator comprises a spring biasing the cam in the first cam position or the second cam position.

14. A displacement actuator comprising:

a housing adapted to removably secure the displacement actuator to a document acceptor;

a lever coupled to the housing;

a cam operatively coupled to the lever, wherein rotation of the lever causes the cam to transition between a first cam position and a second cam position wherein the cam is configured to interface with a document cassette when moving to the second cam position to change a position of the document cassette from a first position to a second position to mate the document cassette with a document validator, the document validator configured to authenticate received documents and the document cassette configured to store the documents received by the document validator, wherein the housing is held in a fixed position relative to the document validator while the position of the document cassette is changed from the first position to the second position.

15. The displacement actuator of claim 14, wherein actuation of the lever causes the displacement actuator to change the position of the document cassette from the first position to the second position to mate the document cassette with the document validator.

16. The displacement actuator of claim 15, wherein actuation of the lever through a predetermined range of motion causes the displacement actuator to change the position of the document cassette to the second position, wherein the second position varies based on a position of the document validator.

17. The displacement actuator of claim 14, wherein the first position is an initial position and the second position is a final position, wherein the displacement actuator is adapted to cause the position of the document cassette to change to the initial position or the final position when the position of the document cassette is not the initial position or the final position.

18. The displacement actuator of claim 14, wherein the displacement actuator includes the lever for actuation and an assist mechanism that provides mechanical advantage such that changing the position of a document cassette containing documents requires substantially the same amount of force on the lever as changing the position of a document cassette that is empty of documents.

19. The displacement actuator of claim 14, the document acceptor further comprising a chassis and the document cassette includes features adapted to soft lock the document cassette to the chassis when the displacement actuator is in a down position and the document cassette can be removed, the features further adapted to lock the document cassette to the chassis when the displacement actuator is in an up position and the document cassette is mated to the document validator.

20. A document acceptor comprising:

a document validator configured to authenticate received documents;

a document cassette configured to store the documents received by the document validator;

a displacement actuator including a housing, a lever, and a cam operatively coupled to the lever, wherein rotation of the lever causes the cam to transition between a first cam position and a second cam position, wherein the cam is configured to interface with the document cassette when moving to the second cam position to change a position of the document cassette from a first position to a second position to mate the document cassette with the document validator, wherein the housing of the displacement actuator is held in a fixed position relative to the document validator while the position of the document cassette is changed.

21. The document acceptor of claim 1, wherein the change of the position of the document cassette from the first position to the second position to mate the document cassette with the document validator is in a second direction.

* * * * *